US005472279A

United States Patent [19]

Lin

[11] Patent Number: 5,472,279

[45] Date of Patent: Dec. 5, 1995

[54] FOLDABLE HEAT-PRESERVING BAG

[76] Inventor: Chen-Hsiung Lin, No. 174, Pi Tan Village, Lu Tsao Hsiang, Chia I Hsien, Taiwan

[21] Appl. No.: 229,739

[22] Filed: Apr. 19, 1994

[51] Int. Cl.[6] ..... B65D 30/08; B65D 30/20; B65D 33/24

[52] U.S. Cl. ..... 383/2; 383/110; 383/113

[58] Field of Search ..... 383/2, 110, 113

[56] References Cited

U.S. PATENT DOCUMENTS

| | | | |
|---|---|---|---|
| 1,636,838 | 7/1927 | Roser | 383/2 |
| 2,107,216 | 2/1938 | Rogers | 383/113 |
| 3,425,470 | 2/1969 | Wuest | 383/2 |
| 4,537,313 | 8/1985 | Workman | 383/113 |
| 4,598,746 | 7/1986 | Rabinowitz | 383/110 |
| 4,648,121 | 3/1987 | Lowe | 383/113 |
| 4,805,776 | 2/1989 | Namgyal et al. | 383/110 |
| 5,149,203 | 9/1992 | Sacks | 383/110 |
| 5,190,376 | 3/1993 | Book | 383/110 |
| 5,354,131 | 10/1994 | Mogil | 383/110 |
| 5,403,095 | 4/1995 | Melk | 383/110 |

*Primary Examiner*—Stephen P. Garbe

*Attorney, Agent, or Firm*—Morton J. Rosenberg; David I. Klein

[57] ABSTRACT

A foldable heat-preserving bag has a bag body with an upper opening, a lid to close on the upper opening of the bag body by means of zippers sewn on the bag body and the lid. A heat-preserving layer is made up of a foam rubber portion and a tin foil portion adhered and pressed together and sewn with the bag body. And, a water-proof rubber bag is stuck with the heat-preserving layer by means of sticker fastener bands provided on the heat-preserving layer and forms a preserving space in its interior for preserving things.

1 Claim, 3 Drawing Sheets

FOLDABLE HEAT-PRESERVING BAG

BACKGROUND OF THE INVENTION

Nowadays many kinds of heat-preserving cases are in use for carrying cool or hot drinks, foods, but they are generally made to have a certain solid form unchangeable, sometimes causing inconvenience.

SUMMARY OF THE INVENTION

This invention has been devised to offer a foldable heat-preserving bag of a simple structure to carry cool or hot drinks, foods, etc. and changeable in its dimensions to suit to that of things being preserved and carried therein, and besides, it is possible to be folded to become as a small dimensions as possible when not in use.

A foldable heat-preserving bag has a bag body with an upper opening, a lid closing the upper opening of the bag body by means of zippers provided on the lid and the bag body, a heat-preserving layer sewn with an inner surface of the lid and the bag body and consisting of a layer of foam rubber and a layer of tin foil adhered and pressed together, and a water-proof rubber bag stuck with the heat-preserving layer by means of sticker fastener bands provided on the heat-preserving layer and the water-proof rubber bag. And a preserving space is formed inside the water-proof rubber bag for preserving drinks, foods. etc. A plurality of sticker fastener bands are provided both in the lid and on the bag body for adjusting the dimensions of the bag for decreasing the bag dimensions for convenience of folding.

This bag has been planned to have the following advantages:

1. It is convenient for carrying drinks, foods, etc. cool or hot, and possible to keep their heat or cold by means of a heat-preserving layer.
2. Cold drinks and foods can often give rise to water drops to moisten a bag body, but the bag in the present invention has a water-proof rubber bag to prevent the bag body from wetted.
3. The size of the bag can be adjusted by means of folding and sticking by means of the sticker fastener bands provided on the lid and the bag body, depending upon the dimensions of things preserved therein.

BRIEF DESCRIPTION OF DRAWINGS

The invention will be better understood by reference to the accompanying drawings, wherein.

DESCRIPTION OF PREFERRED EMBODIMENTS

Figure 1:
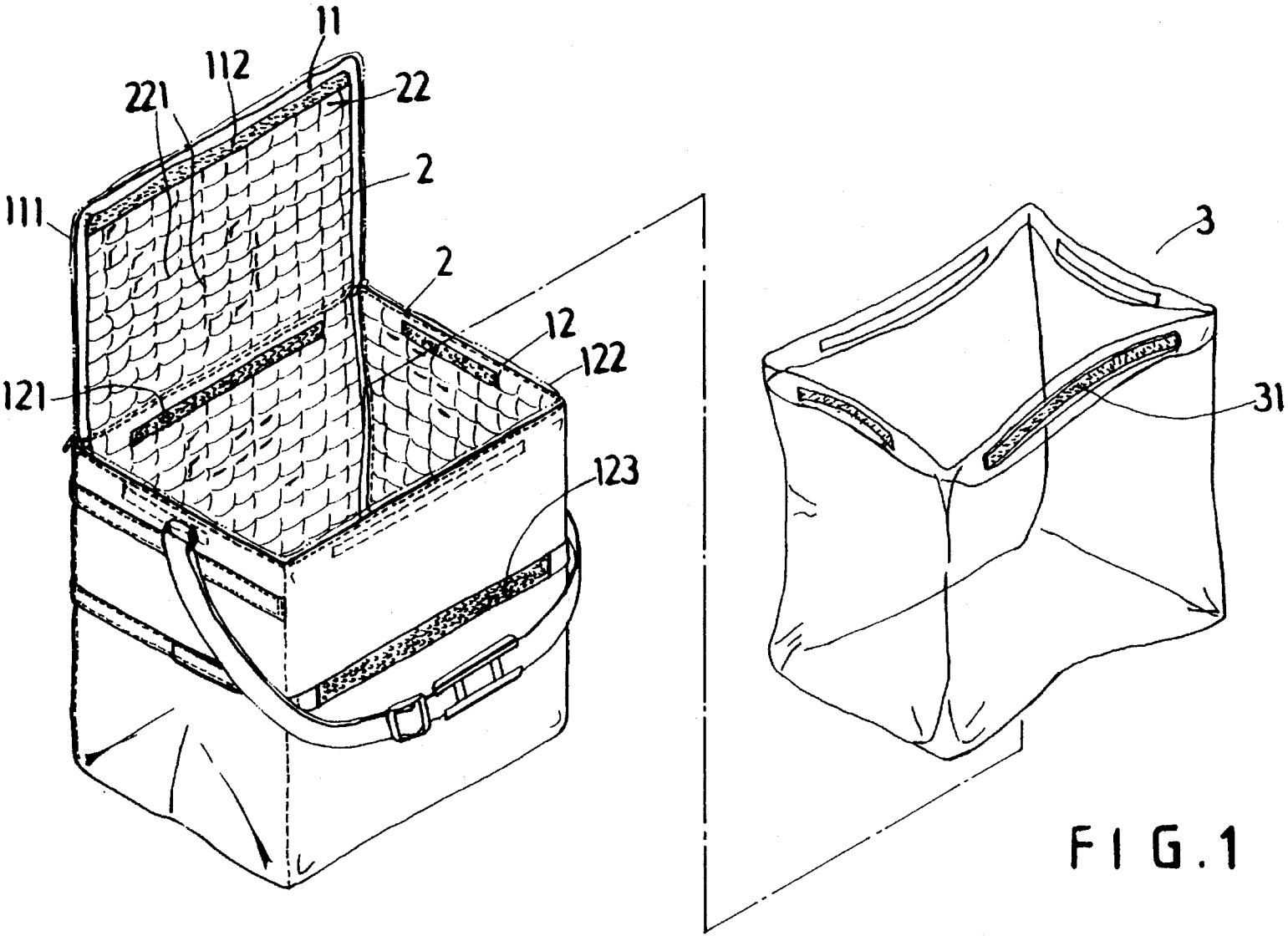
FIG. 1 is an exploded perspective view of a foldable heat-preserving bag in the present invention.
Figure 2:
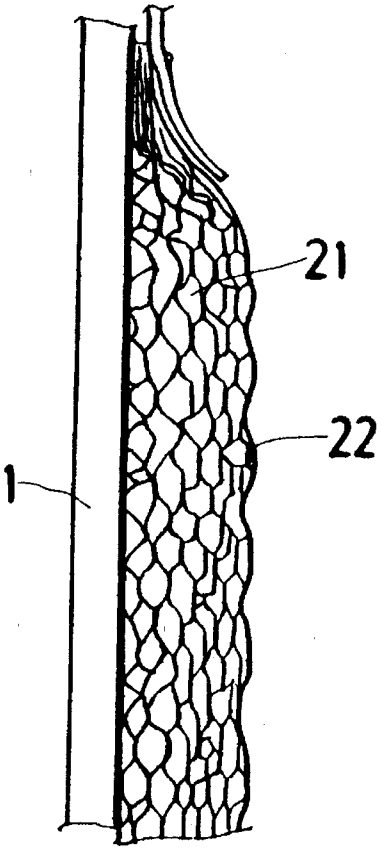
FIG. 2 is a part cross-sectional view of the foldable heat-preserving bag in the present invention.
Figure 3:
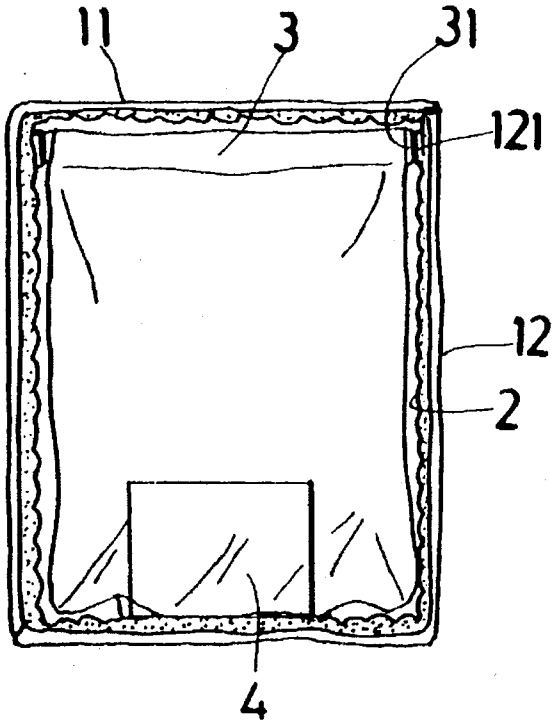
FIG. 3 is a cross-sectional view of the foldable heat-preserving bag in the present invention.

A foldable heat-preserving bag in the present invention, as shown in FIG. 1, includes a bag body 1, a lid 11, a heat-preserving layer 2 sewn with an inner side of the bag body 1 and a water-proof rubber bag 3 stuck with an inner side of the heat-preserving layer 2 by means of sticker fastener bands 121, 31 and forming a preserving space 12 in its interior for putting things to be preserved and carried in the space 12.

The heat-preserving layer 2 is made up of a foam rubber layer 21 and a tin foil layer 22 adhered and pressed together, being sewn with the inner wall of the bag body 1 and the lid 11. The tin foil layer 22 is formed with many recessed lines 221 of grid shapes for convenience of folding the heat-preserving layer 2 with the bag body 1. A plurality of sticker fastener bands 121 are provided on four vertical walls and a bottom of the heat-preserving layer 2 to stick with a plurality of sticker fastener bands 31 on the water-proof rubber bag 3 so that the water-proof rubber bag 3 may be placed stably inside the heat-preserving layer 2, forming the preserving space 12 for preserving things 4 such as drinks fruits, or foods to be preserved therein, and preventing the heat-preserving layer 2 from moistened by cold drinks or foods.

The lid 11 has its two opposite side edges and a front side edge sewn with zippers 111, and the bag body 1 has its upper two opposite side edges and an upper front side edge sewn with zippers 122 to engage with the zippers 111 of the lid 11 for closing the lid 11 with the bag body 1. The lid 11 also has a sticker fastener band 112 on an inner front surface and the bag body 1 has a sticker fastener band 123 laterally provided on an outer surface of a front side, two sticker fastener bands 124, 124 laterally provided on two opposite outer sides and a sticker fastener band 125 provided laterally on a rear outer side as shown in FIG. 6.

Figures 4, 5, 6:
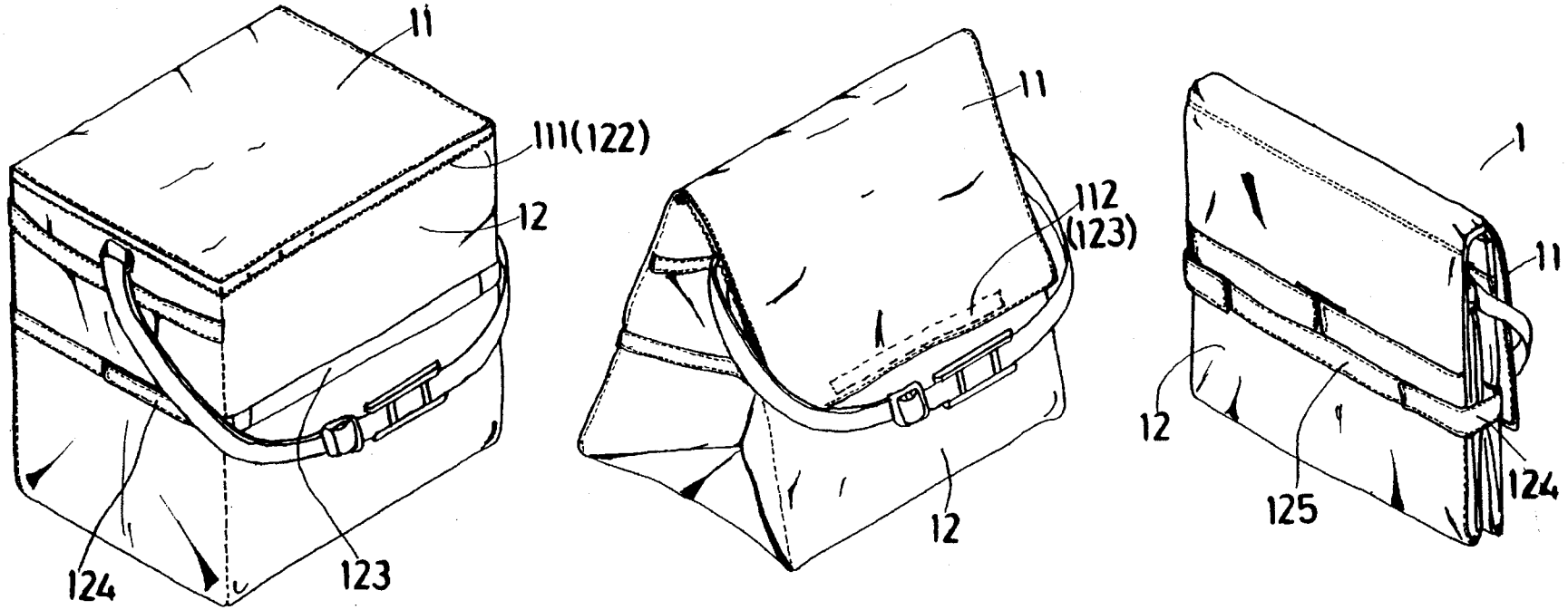
FIG. 4 is a perspective view of a lid and the bag body closely combined together in the present invention.
FIG. 5 is a perspective view of the lid closed by means of sticker fastener bands and two opposite sides of the bag body folded inward, decreasing the dimensions of the bag for preserving in the present invention; and, FIG. 6 is a perspective view of the foldable heat-preserving bag folded into a minimum sized in the present invention.

When this bag is used, a user can close the lid 11 with the bag body 1 either by means of the zippers 111, 122 or the sticker fastener bands 112, 123, depending upon the dimensions of the goods being preserved in the preserving space 12, as shown in FIG. 4 or FIG. 5. In case that the bag is not used, as shown in FIG. 6, the two opposite sides of the bag body 1 are folded toward each other, and the two sticker fastener bands 124, 124 on the two opposing sides are pulled backward to stick with the rear sticker fastener band 125, decreasing the dimensions of the bag and thereby maintaining the folded condition shown in FIG. 6.

While the preferred embodiments of the invention have been described above, it will be recognized and understood that various modifications may be made therein and the appended claims are intended to cover all such modifications which may fall within the spirit and scope of the invention.

What is claimed is:

1. A foldable heat-preserving bag having a bag body comprising:

an tipper opening;

a lid releasably securable to the bag body to close said upper opening;

a heat-preserving layer sewn to both an inner surface of said bag body and said lid, said heat-preserving layer further including a foam rubber layer and a tin foil layer adhered and pressed together, said tin foil layer being provided with a plurality of recesses defining a grid patterns: and, a water-Drool rubber bag attached to an inner side of said heat-preserving layer, said water-proof rubber bag having a preserving space formed therein.

* * * * *